US011215174B2

(12) United States Patent
Hannemann et al.

(10) Patent No.: US 11,215,174 B2
(45) Date of Patent: Jan. 4, 2022

(54) DIAPHRAGM PUMP HAVING A POROUS, ARCHED ALUMINUM FILTER

(71) Applicant: Dipl. Ing. Ernst Schmitz GmbH & Co. KG Maschinen und Apparatebau, Toenisvorst (DE)

(72) Inventors: Frank Hannemann, Roettenbach (DE); Sebastian Rahm, Dresden (DE); Marcus Weder, Bannewitz OT Haenichen (DE)

(73) Assignee: Dipl. Ing. Ernst Schmitz GmbH & Co. KG Maschinen und Apparatebau, Toenisvorst (DE)

( * ) Notice: Subject to any disclaimer, the term of this patent is extended or adjusted under 35 U.S.C. 154(b) by 467 days.

(21) Appl. No.: 16/327,584

(22) PCT Filed: Aug. 22, 2017

(86) PCT No.: PCT/EP2017/071089
§ 371 (c)(1),
(2) Date: Mar. 5, 2019

(87) PCT Pub. No.: WO2018/036995
PCT Pub. Date: Mar. 1, 2018

(65) Prior Publication Data

US 2021/0293235 A1 Sep. 23, 2021

(30) Foreign Application Priority Data

Aug. 25, 2016 (DE) ..... 10 2016 216 012.5

(51) Int. Cl.
*F04B 45/04* (2006.01)
*F04B 53/20* (2006.01)
(Continued)

(52) U.S. Cl.
CPC ..... *F04B 45/04* (2013.01); *F04B 43/02* (2013.01); *F04B 45/053* (2013.01); *F04B 53/20* (2013.01)

(58) Field of Classification Search
None
See application file for complete search history.

(56) References Cited

U.S. PATENT DOCUMENTS 3,138,856 A 6/1964 Kuchek
4,180,353 A 12/1979 Geidies
(Continued)

FOREIGN PATENT DOCUMENTS

DE 427455 C 4/1926
DE 449676 C 9/1927
(Continued)

OTHER PUBLICATIONS

International Search Report of PCT/EP2017/071089, dated Nov. 17, 2017.
(Continued)

*Primary Examiner* — Charles G Freay
(74) *Attorney, Agent, or Firm* — Collard & Roe, P.C.

(57) ABSTRACT

A diaphragm pump for fluidizing, pressurizing, and conveying products in the form of dust, such as coal dust, using inert gas having pressures of up to 7 MPa has a porous, arched aluminum loosening element and optionally a dual diaphragm. The diaphragm pump ensures that fluidizing gas is supplied and distributed uniformly in the dust pump lower region, and the contour of the dust chamber may be adapted to the deflection of the diaphragm and possibly to the guide rod of the diaphragm. Uniform and reversible deformation of the diaphragm with as little wear as possible is thereby achieved. After the discharge operation of the diaphragm pump has ended, largely planar contact of the diaphragm on
(Continued)

the arched, half-shell-shaped loosening surface and a small dead volume can be achieved, leading to a minimal dust chamber volume together with a high delivery rate and a small high-pressure gas loss.

20 Claims, 5 Drawing Sheets

(51) Int. Cl.
*F04B 43/02* (2006.01)
*F04B 45/053* (2006.01)

(56) References Cited

U.S. PATENT DOCUMENTS

| | | | | |
|---|---|---|---|---|
| 4,818,191 | A | 4/1989 | Schlake | |
| 6,447,216 | B1 | 9/2002 | Higuchi et al. | |
| 6,464,474 | B2 | 10/2002 | Schluecker | |
| 6,796,215 | B1 | 9/2004 | Hauser et al. | |
| 7,607,398 | B2 | 10/2009 | Tietze et al. | |
| 8,851,406 | B2 | 10/2014 | Sonwane et al. | |
| 9,138,672 | B2 * | 9/2015 | Ehrich | C10J 3/38 |
| 9,347,444 | B2 | 5/2016 | Nettesheim et al. | |
| 10,781,807 | B2 * | 9/2020 | Hannemann | F04B 43/0054 |
| 10,914,299 | B2 * | 2/2021 | Hannemann | F04B 15/02 |
| 2007/0065308 | A1 | 3/2007 | Yamamoto et al. | |
| 2007/0074643 | A1 | 4/2007 | Tietze et al. | |
| 2010/0021247 | A1 | 1/2010 | Aldred et al. | |
| 2011/0100274 | A1 | 5/2011 | Kuske et al. | |
| 2011/0155662 | A1 | 6/2011 | Liu et al. | |
| 2012/0122042 | A1 | 5/2012 | Brueggemann | |
| 2014/0037466 | A1 | 2/2014 | Nettesheim et al. | |
| 2014/0112802 | A1 | 4/2014 | Hannemann et al. | |
| 2019/0063419 | A1 * | 2/2019 | Hannemann | F04B 45/04 |

FOREIGN PATENT DOCUMENTS

| | | | |
|---|---|---|---|
| DE | 485635 | C | 11/1929 |
| DE | 551066 | C | 5/1932 |
| DE | 568999 | C | 1/1933 |
| DE | 596565 | C | 5/1934 |
| DE | 615779 | C | 7/1935 |
| DE | 650988 | C | 10/1937 |
| DE | 656009 | C | 1/1938 |
| DE | 1008201 | B | 5/1957 |
| DE | 1175653 | B | 8/1964 |
| DE | 81606 | A1 | 4/1971 |
| DE | 2722931 | A1 | 11/1978 |
| DE | 147188 | A3 | 3/1981 |
| DE | 3035745 | A1 | 5/1982 |
| DE | 3909800 | A1 | 9/1990 |
| DE | 10 2005 047 583 | A1 | 4/2007 |
| DE | 102008007033 | A1 | 8/2009 |
| DE | 102008009679 | A1 | 8/2009 |
| DE | 102008049542 | A1 | 4/2010 |
| DE | 102008052673 | A1 | 4/2010 |
| DE | 102009016191 | A1 | 10/2010 |
| DE | 102008049542 | B4 | 12/2011 |
| DE | 10 2011 007 066 | A1 | 10/2012 |
| DE | 102011052432 | A1 | 10/2012 |
| DE | 102009016191 | B4 | 4/2013 |
| DE | 10 2012 216 084 | A1 | 3/2014 |
| DE | 202007019632 | U1 | 1/2015 |
| DE | 10 2014 212 919 | A1 | 1/2016 |
| DE | 10 2016 201 182 | A1 | 7/2017 |
| EP | 0 732 501 | A1 | 9/1996 |
| EP | 1 134 414 | A2 | 9/2001 |
| GB | 2004993 | A | 4/1979 |
| JP | H06-11070 | Y2 | 5/1991 |
| WO | 92/19866 | A1 | 11/1992 |
| WO | 01/14744 | A1 | 3/2001 |
| WO | 2009095290 | A2 | 8/2009 |
| WO | 2009095290 | A3 | 8/2009 |
| WO | 2010037601 | A1 | 4/2010 |

OTHER PUBLICATIONS

International Search Report of PCT/EP2017/071073, dated Dec. 6, 2017.

International Search Report of PCT/EP2017/071066, dated Dec. 5, 2017.

Industriepumpen + Kompressoren, "Prozesspumpen mit zustandsüberwachter redundanter Schlauchmembran-Einspannung" (with English translation of title page and Abstract of article) Industry pumps + Compressors: Magazine for the praxis of pump and compressor technique, "Process pumps with condition-watched redundant hose membrane gripping," by Heinz M. Naegel, 16 year, brochure 3, 2010, pp. 120-123.

International Search Report dated May 2, 2017, for PCT/EP2016/081838.

* cited by examiner

DIAPHRAGM PUMP HAVING A POROUS, ARCHED ALUMINUM FILTER

CROSS REFERENCE TO RELATED APPLICATIONS

This application is the National Stage of PCT/EP2017/071089 filed on Aug. 22, 2017, which claims priority under 35 U.S.C. § 119 of German Application No. 10 2016 216 012.5 filed on Aug. 25, 2016, the disclosures of which are incorporated by reference. The international application under PCT article 21(2) was not published in English.

BACKGROUND OF THE INVENTION

1. Field of the Invention

The invention relates to a diaphragm pump for liquidizing, pressurizing, and conveying products in the form of dust such as, for example, coal dust, with the aid of inert gas at pressures up to 7 MPa, said diaphragm pump having a porous, arched loosening element of aluminum.

2. Description of the Related Art

A continuous and cost-effective dense phase conveying at varying dust quality of combustion dusts for coal and biomass gasification plants is achieving increasing importance in order for gasification plants to be operated in a more economical manner and with a high availability, for example. This objective is in particular achieved by the use of a diaphragm pump as is proposed in patent application DE102016201182 of Jan. 27, 2016. The conveyed material in the form of dust herein is suctioned from below into the diaphragm pump, pressurized and liquidized in a next step, and is subsequently discharged under pressure. The residual gas volume in the dust chamber of the diaphragm pump after the discharge of the conveyed material is relaxed in a last step, and the pumping cycle restarts. By virtue of this cyclical (discontinuous) operating mode, a plurality of pump heads are usually switched in parallel, so as to guarantee a continuous operation. To this end, the individual pump cycles are operated at mutually offset phases. Filter materials which meet the requirements in terms of pressure resistance and temperature resistance are, for example, the metallic woven filtration fabrics, sintered metal, and sintered plastics material, described in DE102012216084. The robust materials described are available only in a flat or plate-type structure and not in the required size or dimension, respectively. Mechanical processing to other geometric shapes such as, for example, arched half-shells, is not possible by virtue of the required filter fineness and of the damage to or the smearing of the porous filter structure, respectively, created in the mechanical processing.

A process pump, the double diaphragm of which is monitored for integrity by means of a coupling liquid and a connection to a diaphragm rupture display, is known from the special print from "Industriepumpen+Kompressoren" ("Industrial pumps+Compressors"), Volume 16, Edition 3-2010, pages 120-123, Vulkan-Verlag Essen, titled "Prozesspumpen mit zustandsüberwachter redundanter Schlauchmembraneinspannung" ("process pumps having a status-monitored redundant tubular diaphragm clamping mechanism") by Heinz M. Nägel.

SUMMARY OF THE INVENTION

The invention is based on the object of achieving a diaphragm pump having an integrated filter element for feeding swirl and pressurization gas into the pressure vessel of the diaphragm pump, said diaphragm pump combining the requirements of pressure resistance, temperature resistance, sufficient filter fineness, low-complexity production capability, and interaction with the diaphragm for the purpose of high diaphragm availability.

The object is achieved by a diaphragm pump having the features according to the invention.

The invention utilizes the concept that a uniformly distributed infeed of the swirl gas in the lower region of the dust pump is essential to the operating mode of the diaphragm pump. In the case of the diaphragm pump according to the invention, by way of the loosening element thereof it is ensured that any potential smearing of the material is avoided, and a uniform porosity is implementable, on account of a processing to an arched filter element having a three-dimensional shaping.

The loosening element according to the invention has a constant porosity, on account of which it can be ensured that the finest dust particles cannot invade the loosening face during the relaxation procedure of the dust chamber, which causes a uniformly distributed infeed of swirl gas into the dust chamber during the pressurizing procedure.

The invention permits a constructive design of the dust chamber in which the contour thereof is particularly advantageously adapted to the deflection of the diaphragm and optionally to the guide rod of the diaphragm. On account thereof, a uniform and reversible deformation of the diaphragm with ideally low wear is achieved.

After the completion of the discharging procedure of the diaphragm pump a largely planar bearing of the diaphragm (3) on the arched, half-shell-shaped loosening face (5) can be achieved. On account of this advantageous design embodiment, a minor dead volume is achievable, which leads to a minimal dust chamber volume (10) at a simultaneously high conveying rate and a low loss of high-pressure gas.

In the case of a hydraulically driven diaphragm pump for the pneumatic high-pressure conveying of liquidized dusts which is equipped with the filter element 5 according to the invention, the pressure vessel enclosing the dust chamber has minor dimensions with a minimized wall thickness, which leads to a reduction in the production complexity.

In one particular embodiment of the invention, the loosening face 5 at the lowest point has a circular opening to which a dust pipe 7 is fastened, the conveyed material in the form of dust being able to be conveyed in and out through said dust pipe 7 and thus unable to make its way into the gas chamber 13.

Advantageous refinements of the invention are discussed below.

BRIEF DESCRIPTION OF THE DRAWINGS

The invention, to the extent required for understanding, will explained as exemplary embodiments in more detail hereunder by means of the drawings, wherein.

DETAILED DESCRIPTION OF THE PREFERRED EMBODIMENTS

Figure 1:
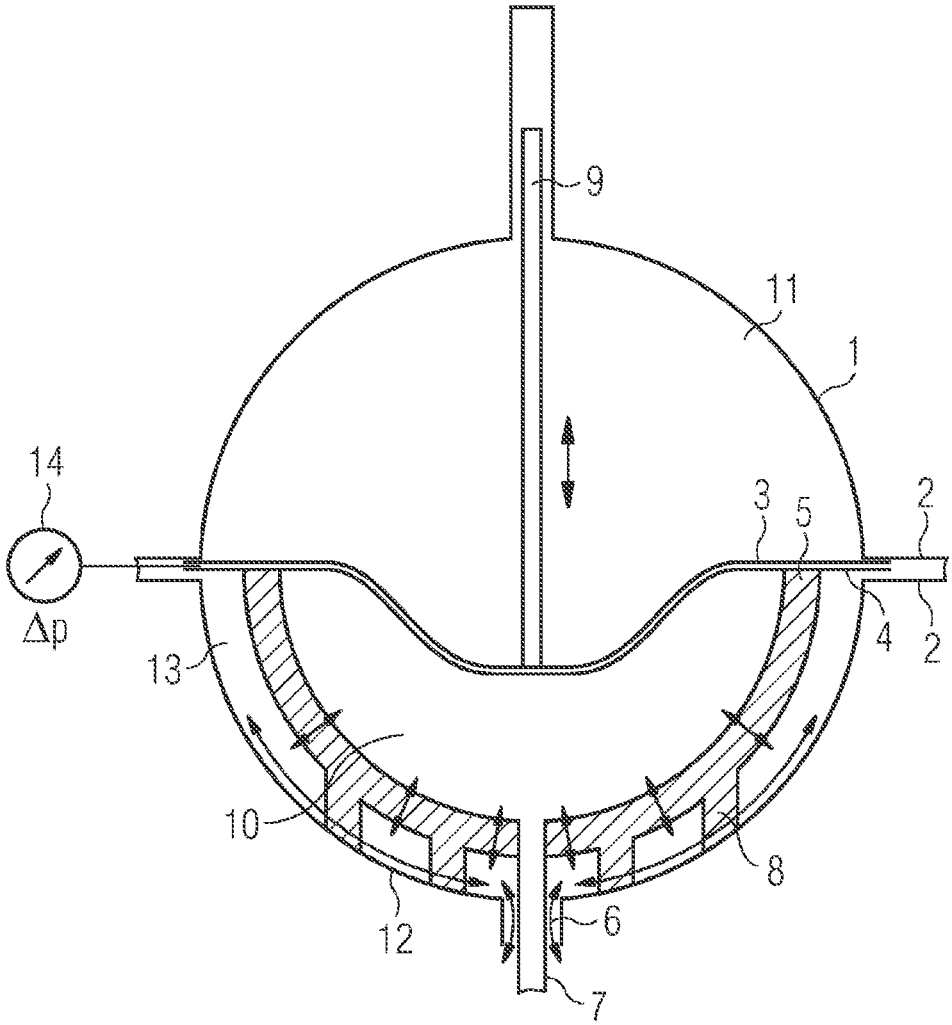
FIG. 1 shows a diaphragm pump in an embodiment of the invention.

The diaphragm pump illustrated in FIG. 1 is a device composed of two pressure-resistant half-shells (1, 12) which are connected to one another in a gas-tight manner by way of a flange connection (2). Apart from a simple disassembly potential of the dust pump, the flange connection has the additional function of fastening and clamping the diaphragm (3) and the loosening face (5) by way of a filter flange (4). On account of the spherical geometry, an advantageous and filter-material preserving deflection of the diaphragm into the dust chamber in the form of a paraboloid of revolution can thus take place. The deflection of the diaphragm herein is effected by an impingement by the force of the hydraulic liquid, as is described in DE102016201182, for example. Abrupt variations are avoided, and after the completion of the outward conveying procedure a largely planar bearing of the diaphragm (3) on the half-shell-shaped loosening face (5) can be achieved. On account of this advantageous design embodiment a minor dead volume is achievable, which leads to a minimal dust chamber volume (10) at a simultaneously high conveying rate and a low loss of high-pressure gas. In order to avoid undesirable movements and creases during the discharging procedure, the diaphragm in terms of the movement thereof is guided and stabilized by way of a guide rod (9). In a particularly advantageous embodiment the guide rod can assume additional tasks such as, for example, that of determining a position of the diaphragm by way of metrological position encoders.

The invention is furthermore based on the object of generating dense phase conveying, described in DE 102005047583, by generating a liquidized layer within the dust chamber. This during the liquidizing and discharging procedure is provided by a homogenous infeed of gas by way of a half-shell-shaped loosening face (5) which is embodied so as to be gas-permeable. Porous metal, for example aluminum, having a sufficiently small pore size and a filter fineness of <20 μm is used as filter material for the loosening face (5). It can thus be ensured that the finest dust particles do not invade the loosening face during the relaxation procedure. Liquid metal, for example aluminum, together with granulated salt, is cast into a half-shell-mold for the production of porous metal. As opposed to metal such as aluminum, for example, salt has a substantially higher melting point and does not pass to the liquid aggregate state but is uniformly distributed in the melt. After the solidification of the metal the salt is washed out with the aid of a salt-dissolving liquid, and a porous and gas-permeable metal is created. An advantage of this method lies in the possibility of carrying out mechanical processing prior to washing out the salt crystals. On account thereof, smearing of the pores is precluded. The required porosity and filter fineness are adjusted by way of the size of the salt grains.

In one particular design embodiment of the invention the hydraulics half-shell (1) has an internal diameter that is smaller than the internal diameter of the dust half-shell (12). The arched loosening face (5) can be fixed on account of this constructive measure.

Figure 2:
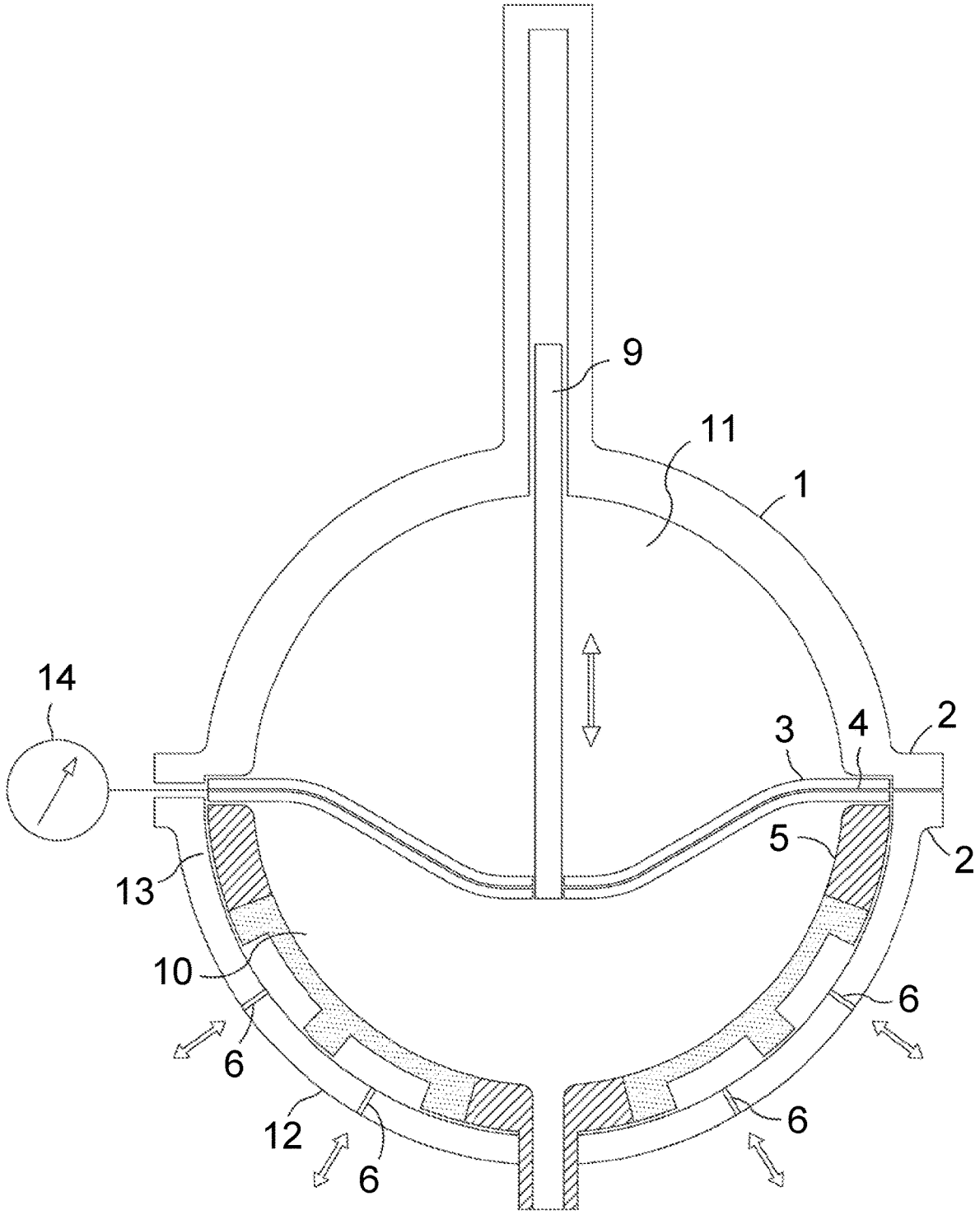
FIG. 2 shows an embodiment of the diaphragm pump wherein the loosening face is embodied in a layered manner from solid material in the region of the flange connection and porous material in the remaining region and the gas is supplied and removed through a plurality of openings that are uniformly distributed in the dust half-shell.

In order to obtain an advantageous flange sealing (2), the loosening face (5) can be embodied as a half-shell having a flange periphery, molded in two layers, as a porous metal in the lower region and as solid material in the flange region. See FIG. 2.

Figure 3:
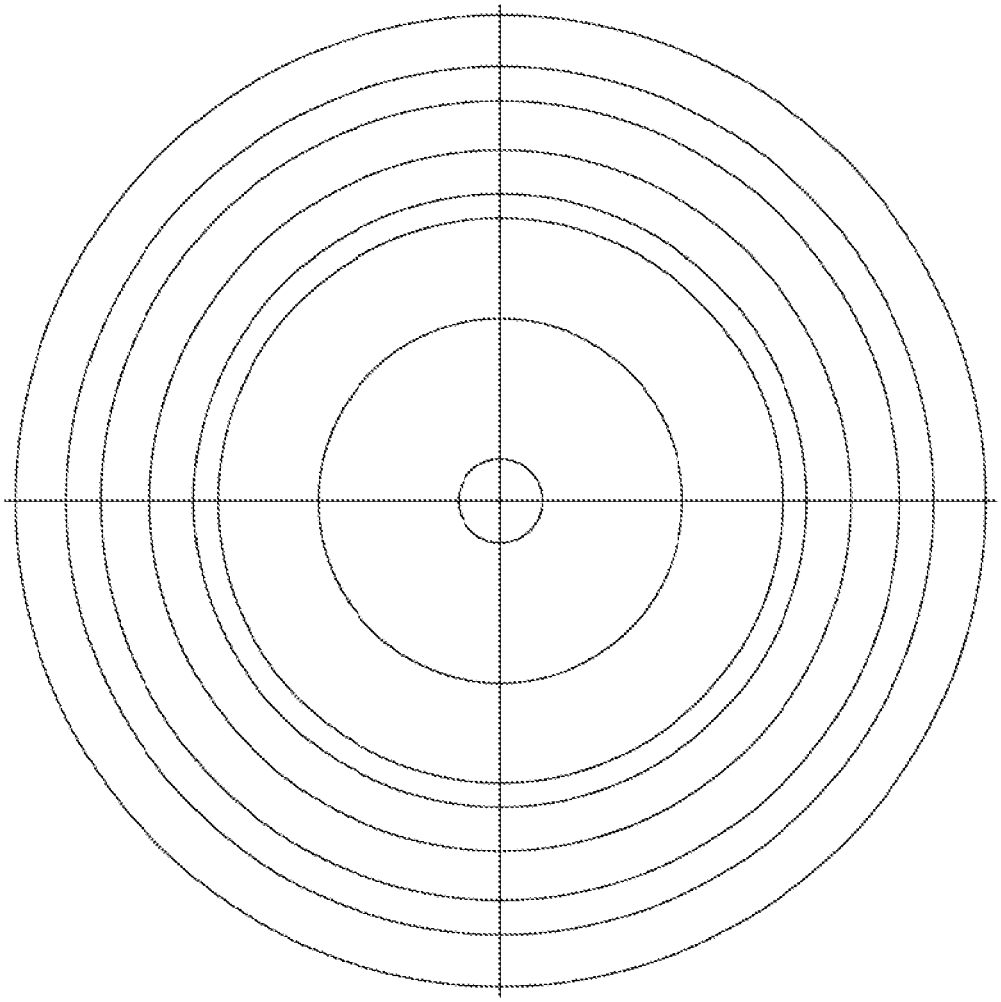
FIG. 3 shows annular support elements.
Figure 4:
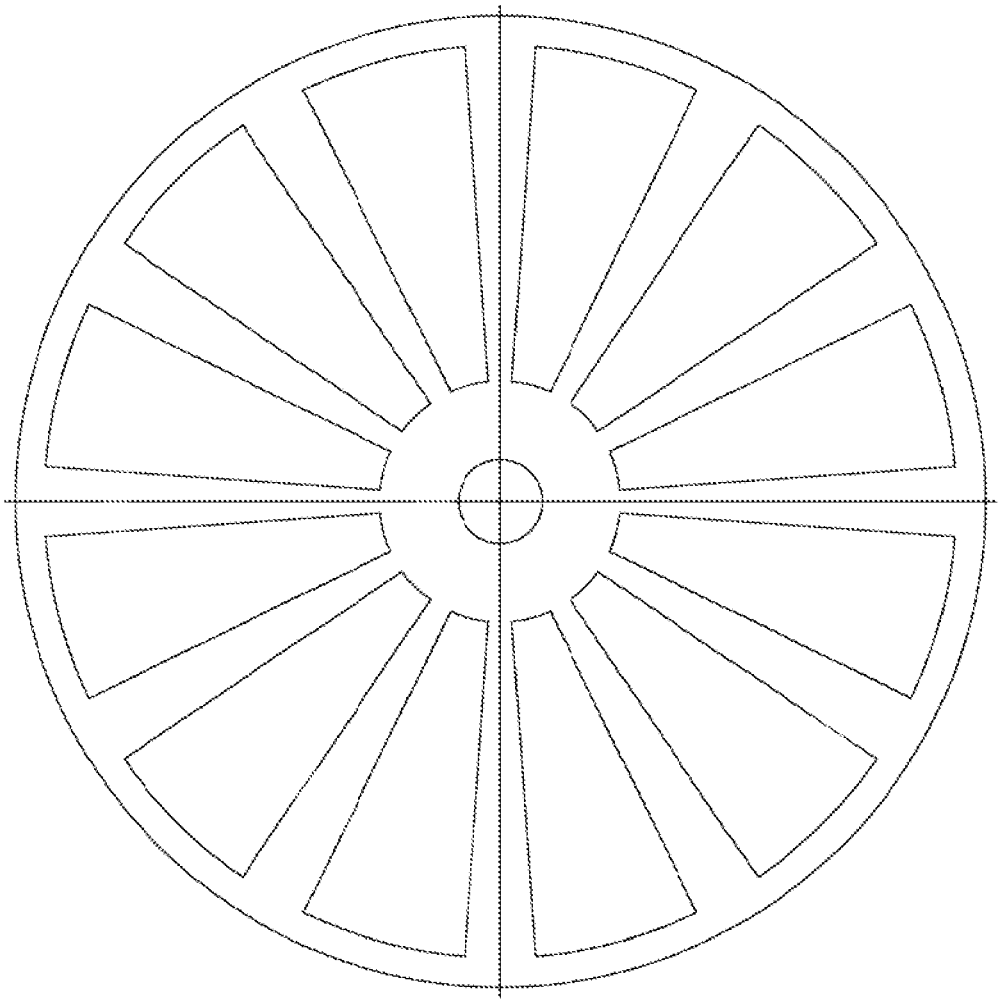
FIG. 4 shows straight wall support elements.
Figure 5:
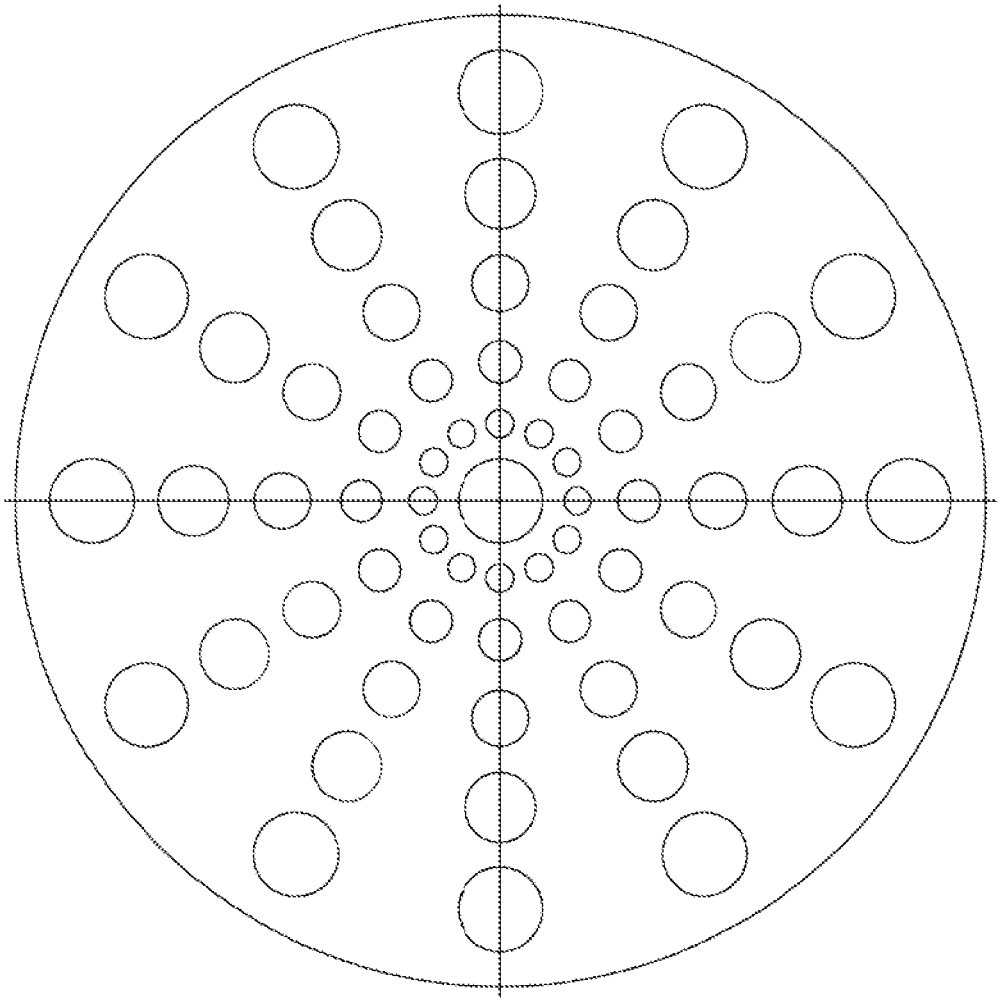
FIG. 5 shows punctiform support elements.

In one particular design embodiment of the invention the half-shell-shaped casting mold of the loosening face (5) is complemented by way of additional annular (FIG. 3), straight wall (FIG. 4) and/or punctiform (FIG. 5) support elements (8). The half-shell-shaped loosening face (5) which is composed of a porous metal can thus be fitted and fastened in the lower pressure-resistant half-shell (12) which is composed of solid material.

In one particular embodiment of the invention a central, in particular annular, support element 8 which encloses the dust pipe 7 and optionally the gas pipe 6 which is concentric with said dust pipe 7 is disposed.

A gas chamber 13 which can be used for the distribution of the loosening and pressurizing gas is advantageously created between the loosening face composed of porous metal and the pressure-resistant half-shell. The infeeding and outfeeding of the loosening and pressurizing gas is performed by way of openings 6 in the lower pressure-resistant half-shell 12.

In the case of a hydraulically driven diaphragm pump for the pneumatic high-pressure conveying of liquidized dusts, particular importance is afforded to the reliable sealing of the dust chamber from the hydraulics chamber, said two chambers being separated by the diaphragm. The deflection of the diaphragm and the associated suctioning and discharging of the conveyed material in the form of dust is achieved by forcing in and forcing out the hydraulic liquid in the hydraulics chamber that is situated above the diaphragm. Within this conveying procedure, the ingress of dust into the hydraulic liquid, or of hydraulic liquid into the dust chamber, is associated with significant disruptions to the plant and would lead to complex repairs.

A particular refinement of the invention lies in monitoring and ensuring the diaphragm tightness. To this end, the diaphragm (3) is embodied as a double diaphragm having an integrated pressure sensor for monitoring leakage. A hermetically tight separation between the hydraulics chamber (11) and the dust chamber (10) can thus be ensured, and damage to the diaphragm can be identified in a timely manner. Complex repair and cleaning measures on the entire dust system or hydraulics system in the case of diaphragm damage are prevented, and the tightness of the diaphragm is maintained during the defect.

In the case of an embodiment of the diaphragm 3 as a double diaphragm, two rubber-elastic diaphragms are mutually disposed so as to be mechanically supported on one another in such a manner that a closed intermediate space which is capable of being monitored by means of a pressure sensor Δp (14) is formed between the diaphragms. The intermediate space in the defect-free operation has a pressure which is lower than the pressure in the hydraulics chamber or the dust chamber. When a pressure increase in the intermediate space is now established, the conclusion is drawn that there is a leakage in one of the two diaphragms of the double diaphragm. The two diaphragms can be mechanically supported on one another in punctiform manner in that a tier of balls is disposed between said two diaphragms. The two diaphragms can be mechanically supported on one another in that a coupling liquid which is operatively connected to the pressure sensor Δp is incorporated between said two diaphragms.

The rubber-elastic diaphragm can be formed using an elastomer or a solid PTFE mixture. In the case of the double diaphragm, one of the two diaphragms can be formed by an elastomer, and the other of the two diaphragms can be provided by a solid PTFE mixture.

The invention is also achieved by a diaphragm pump for liquidizing and conveying dusts, in which diaphragm pump:

the pressure-resistant housing of the dust pump is composed of two half-shells which are connected by a flange connection and in which a diaphragm and a loosening face are flange-fitted;

the loosening face is embodied in layers from porous material in the lower region and solid material in the region of the flange connection; and the loosening face is embodied as a half shell, contains support elements, and a gas chamber exists between the pressure-resistant lower half-shell and the loosening face.

The present invention for the purpose of illustration has been explained in detail by means of specific exemplary embodiments. Elements of the individual exemplary embodiments herein can also be combined with one another. The invention is therefore not intended to be limited to individual exemplary embodiments but is intended to be limited only by the appended claims.

LIST OF REFERENCE SIGNS

1 Pressure-resistant upper half-shell, hydraulics half-shell
2 Container flange
3 Diaphragm
4 Filter flange
5 Loosening face composed of porous metallic filter material
6 Openings for pressurizing and conveying gas, gas pipe
7 Internal pipe for the entry and exit of the dust, dust pipe
8 Annular, punctiform, stripe-shaped support elements
9 Diaphragm guide/guide rod
10 Dust chamber
11 Hydraulics chamber
12 Pressure-resistant lower half-shell, dust half-shell
13 Gas chamber
14 Pressure sensor Δp

The invention claimed is:

1. A diaphragm pump for liquidizing and conveying dust at pressures up to 7 MPa, which diaphragm pump comprises:

a housing;

a diaphragm in the housing separating a hydraulics chamber from a dust chamber;

wherein the housing is formed having a pressure-resistant hydraulics half-shell that faces the hydraulics chamber, and a pressure-resistant dust half-shell that faces the dust chamber;

a gas-permeable loosening face which is embodied from porous material and is arched and disposed in the dust chamber;

a gas chamber for supplying gas, wherein the gas chamber is present between the dust half-shell and the loosening face; and a support element disposed between the dust half-shell and the loosening face.

2. The diaphragm pump as claimed in claim 1, wherein the hydraulics half-shell and the dust half-shell are connected by a flange connection, and the diaphragm is flange-fitted in the flange connection.

3. The diaphragm pump as claimed in claim 2, wherein the loosening face is embodied in a layered manner from solid material in the region of the flange connection and porous material in the remaining region.

4. The diaphragm pump as claimed in claim 1, wherein the dust is supplied by way of a dust pipe that penetrates the loosening face and is removed by way of the dust pipe.

5. The diaphragm pump as claimed in claim 4, wherein the gas is supplied to the gas chamber by a gas pipe that concentrically encloses the dust pipe and is removed from the gas chamber by the gas pipe.

6. The diaphragm pump as claimed in claim 2, wherein the diaphragm is guided in the hydraulics half-shell by a guide rod.

7. The diaphragm pump as claimed in claim 1, wherein the gas is supplied and removed through a plurality of openings that are uniformly distributed in the dust half-shell.

8. The diaphragm pump as claimed in claim 1, wherein the gas is supplied and removed through a plurality of openings in the dust half-shell, wherein the openings are connected tangentially to the dust half-shell.

9. The diaphragm pump as claimed in claim 4, wherein the dust pipe is fastened to a circular exit opening of the loosening face.

10. The diaphragm pump as claimed in claim 4, wherein the dust pipe is formed using wear-resistant material.

11. The diaphragm pump as claimed in claim 4, wherein the dust pipe is welded to the loosening face.

12. The diaphragm pump as claimed in claim 1, wherein one or a plurality of support elements are embodied so as to be circular in shape.

13. The diaphragm pump as claimed in claim 1, wherein one or a plurality of support elements are embodied so as to form one or more straight walls extending away from the dust pipe.

14. The diaphragm pump as claimed in claim 1, wherein one or a plurality of support elements are embodied so as to be annular.

15. The diaphragm pump as claimed in claim 1, wherein the porous material of the loosening face has a fineness <40 μm.

16. The diaphragm pump as claimed in claim 1, wherein the porous material of the loosening face has a fineness <20 μm.

17. The diaphragm pump as claimed in claim 1, wherein the porous material is produced from a metal melt having embedded salt crystals which are washed out after mechanical finishing.

18. The diaphragm pump as claimed in claim 1, wherein the porous material comprises aluminum.

19. The diaphragm pump as claimed in claim 1, wherein the diaphragm is embodied as a double diaphragm having an intermediate space monitored by a pressure sensor Δp.

20. The diaphragm pump as claimed in claim 1, further comprising an assembly in which the dust chamber is situated below the hydraulics chamber.

* * * * *